US009890477B2

(12) United States Patent
Liu et al.

(10) Patent No.: US 9,890,477 B2
(45) Date of Patent: Feb. 13, 2018

(54) MINT-CONTAINING COMPOSITE CELLULOSE FIBER AND PRODUCTION METHOD THEREOF

(71) Applicant: Easy Health Inc., Centreville, VA (US)

(72) Inventors: Yixin Liu, Centreville, VA (US); Mingliang Jiang, Centreville, VA (US); Pengcheng Li, Centreville, VA (US); Jintao Wu, Centreville, VA (US); Xiaozhi Chen, Centreville, VA (US)

(73) Assignee: BESTEE MATERIAL (TSINGTAO) CO., LTD., Qingdao (CN)

( * ) Notice: Subject to any disclaimer, the term of this patent is extended or adjusted under 35 U.S.C. 154(b) by 0 days.

(21) Appl. No.: 14/829,053

(22) Filed: Aug. 18, 2015

(65) Prior Publication Data

US 2017/0051435 A1 Feb. 23, 2017

(51) Int. Cl.
*D01F 2/10* (2006.01)
*D01D 5/06* (2006.01)

(52) U.S. Cl.
CPC ..... *D01F 2/10* (2013.01); *D01D 5/06* (2013.01); *D10B 2201/01* (2013.01)

(58) Field of Classification Search
CPC ..... D01D 5/06; D01F 2/10; D10B 2201/01
See application file for complete search history.

(56) References Cited

FOREIGN PATENT DOCUMENTS

CN 103225123 B * 12/2014
CN 104762679 A * 7/2015

* cited by examiner

*Primary Examiner* — Kaj K Olsen
*Assistant Examiner* — Alexander Polyansky
(74) *Attorney, Agent, or Firm* — Anova Law Group, PLLC

(57) ABSTRACT

The present disclosure provides mint-containing composite cellulose fibers and production methods thereof. A mint-extract crude solution is prepared from a whole mint plant after at least one water extraction process and at least one ethanol extraction process to provide a mint-extract filtrate and mint-extract residues. The mint-extract filtrate is used as the mint-extract crude solution. The mint-extract crude solution is treated to prepare a mint-extract stock solution by at least a quenching process. A viscose spinning solution is prepared by mixing the mint-extract residues with one or more pulps selected from a cotton pulp, a wood pulp, a bamboo pulp, a wool pulp, a linen pulp, a silk pulp, a Tencel pulp, and a Modal pulp. The one or more pulps contain cellulose. A mint-viscose blend is prepared by dynamically mixing the mint-extract stock solution with the viscose spinning solution and then spun into the mint-containing composite cellulose fiber.

18 Claims, No Drawings

MINT-CONTAINING COMPOSITE CELLULOSE FIBER AND PRODUCTION METHOD THEREOF

FIELD OF THE DISCLOSURE

The present disclosure generally relates to the field of fiber technology and, more particularly, relates to mint-containing composite cellulose fibers and production methods thereof.

BACKGROUND

Cellulose fiber, as one type of the artificial fibers, has a broad range of applications. Because of abundant sources of raw materials, excellent properties, and ecological relevance, cellulose fibers may hold a stable position in the production and application of artificial fibers, and have been gradually developed towards differentiation and functionalization.

Among cellulose fibers, antibacterial cellulose fiber is an important member. However, with the development of fiber science and technology and improvement of people's living standards, consumers may demand textile products to be bacteriostatic, antibacterial, and easy to care, and more importantly, to be natural environmentally friendly. Antibacterial agents from natural resources may facilitate textile products to be antibacterial, without side effects from heavy metal toxicity when performing antibacterial functions, and without allowing bacteria tolerance, therefore textile products can be more healthful.

BRIEF SUMMARY OF THE DISCLOSURE

One aspect or embodiment of the present disclosure includes a method for producing a mint-containing composite cellulose fiber. In this method, a mint-extract crude solution is prepared from a whole mint plant after at least one water extraction process and at least one ethanol extraction process, to provide a mint-extract filtrate and mint-extract residues. The mint-extract filtrate is used as the mint-extract crude solution. The mint-extract crude solution is treated to prepare a mint-extract stock solution by at least a quenching process. A viscose spinning solution is prepared by mixing the mint-extract residues with one or more pulps selected from a cotton pulp, a wood pulp, a bamboo pulp, a wool pulp, a linen pulp, a silk pulp, a Tencel pulp, and a Modal pulp. The one or more pulps contain cellulose. A mint-viscose blend is prepared by dynamically mixing the mint-extract stock solution with the viscose spinning solution and is then spun into the mint-containing composite cellulose fiber.

Optionally, prior to the at least one water extraction process and the at least one ethanol extraction process, to prepare the mint-extract crude solution, the whole mint plant is fibrillated and pulverized into coarse powders having an average size of about 2 mm to about 3 mm. The coarse powders are mixed with water to provide pre-treated coarse powders, followed by the at least one water extraction process.

Optionally, in the at least one water extraction process, the pre-treated coarse powders are mixed with water to form a mixture, steam is introduced into the mixture containing the pre-treated coarse powders and the water to increase a temperature to be about 100° C. for decocting to prepare a decocted solution, and the decocted solution is filtered to provide first filtered residues and a first filtrate containing extracted mint.

Optionally, the water extraction process is repeated on the first filtered residues to provide second filtered residues and a second filtrate. Optionally, in the at least one ethanol extraction process, the second filtered residues are mixed and impregnated with ethanol to provide an ethanol-containing mixture, the ethanol-containing mixture is filtered to provide third filtered residues and an ethanol-containing filtrate, and the ethanol-containing filtrate is distilled to provide a third filtrate that is ethanol-free. A combination of the first, second, and third filtrates forms the mint-extract crude solution.

Optionally, in the quenching process, a temperature of the mint-extract crude solution is increased to be about 100° C. and maintained for about 1 to about 2 hours, and the temperature is quickly reduced to about 10° C. within about 30 minutes.

Optionally, to prepare the mint-extract stock solution, after the quenching process, crystal substances are filtered out from the mint-extract crude solution. A defoaming process is then performed. Optionally, the mint-extract residues are mixed with the one or more pulps at a ratio of about 1:3 to about 1:6 by weight.

Optionally, after mixing the mint-extract residues with the one or more pulps, one or more processes selected from an impregnation process, a squeezing process, a crushing process, an aging process, a xanthation process, and a dissolving process are included to prepare the viscose spinning solution.

Optionally, the whole mint plant further includes raw materials of chloranthus, glaber, apocynum, tuckahoe, isatis root, wormwood, or a combination thereof.

Optionally, an impregnation surfactant of about 0.01% to about 0.02% by weight of the cellulose in the viscose spinning solution is used in the impregnation process, a crush denaturing agent of about 0.02% to about 0.03% by weight of the cellulose in the viscose spinning solution is used in the crushing process, and a dissolution denaturing agent of about 1.0% to about 2.0% by weight of the cellulose in the viscose spinning solution is used in the dissolving process.

Optionally, an impregnation surfactant in the impregnation process includes a hydrophilic anionic surfactant comprising sulfonated castor oil, alkyl ammonium polyoxyethylene glycol, or a combination thereof, a crush denaturing agent in the crushing process includes polyoxyethylene glycol ether, hydroxyethyl aliphatic amine, or a combination thereof, and a dissolution denaturing agent in the dissolving process includes polyethylene glycol, urea, or a combination thereof.

Optionally, when preparing the viscose spinning solution, one or more processes selected from a mixing process, a filtering process, a defoaming process, and a maturation process are further included.

Optionally, the viscose spinning solution has a fiber concentration of about 9.0% by weight of total amount of the viscose spinning solution, an alkali concentration of about 4.80% by weight of total amount of the viscose spinning solution, a viscosity of about 50.0 s/cm$^2$, a degree of maturation with 10% ammonium chloride value of about 14.0 mL, and a filtration resistance constant Kw of about 100 or less.

Optionally, when preparing the mint-viscose blend, prior to spinning, the mint-extract stock solution is added into a dynamic mixer through a metering pump, and the viscose spinning solution is simultaneously added into the dynamic mixer through a viscose flowmeter. The mint-extract stock solution is added in an amount such that extracted mint in the mint-extract stock solution has a ratio with the mint-containing composite cellulose fiber for about 10% to about 20% by weight.

Optionally, when spinning the mint-viscose blend, the mint-viscose blend is introduced in a coagulation bath. The coagulation bath includes about 70 g/L to about 120 g/L of sulfuric acid, about 4 g/L to about 8 g/L of aluminum sulfate, and about 320 g/L to about 350 g/L of sodium sulfate, at a temperature of about 40 to about 60° C.

Optionally, when spinning the mint-viscose blend, a fiber drawing process is conducted having about 20% to about 15% nozzle draw, about 20% to about 45% disc draw, and about 5% to about 20% plasticizing bath draw.

Optionally, when spinning the mint-viscose blend, one or more processes selected from a cutting process, a water washing process, a desulfurizing process, and an oil treating process of the mint-containing composite cellulose fiber are included. The desulfurizing process uses a desulfurizing bath including about 2 g/L to about 6 g/L of sodium sulfite at about 30° C. to about 60° C.

Another aspect or embodiment of the present disclosure includes a mint-containing composite cellulose fiber. The mint-containing composite cellulose fiber includes cellulose of about 85% to about 95% by weight of the total mint-containing composite cellulose fiber, and mint-extract of about 5% to about 15% by weight of the total mint-containing composite cellulose fiber. The mint-extract is contributed from a mint-extract filtrate and mint-extract residues obtained from at least one water extraction process and at least one ethanol extraction process of a whole mint plant. The mint-containing composite cellulose fiber is produced by preparing a viscose spinning solution by mixing the mint-extract residues with one or more pulps selected from a cotton pulp, a wood pulp, a bamboo pulp, a wool pulp, a linen pulp, a silk pulp, a Tencel pulp, and a Modal pulp, preparing a mint-viscose blend by dynamically mixing the viscose spinning solution with the mint-extract filtrate, and spinning the mint-viscose blend into the mint-containing composite cellulose fiber.

Optionally, the mint-containing composite cellulose fiber has a dry breaking strength greater than about 2.0 cN/dtex, a wet breaking strength greater than about 1.1 cN/dtex, a dry breaking elongation greater than about 16%, and a line density deviation of about 7%.

Optionally, the mint-containing composite cellulose fiber has a whiteness of about 38% to about 48%, a bacteriostatic logarithm value greater than about 2.0, a bactericidal logarithm value greater than 0, and a coolness coefficient greater than about 0.20 W/cm$^2$.

Other aspects or embodiments of the present disclosure can be understood by those skilled in the art in light of the description, the claims, and the drawings of the present disclosure.

DETAILED DESCRIPTION

Reference will now be made in detail to exemplary embodiments of the disclosure, but not intend to limit the scope of the present disclosure.

Mint-extract (or extracted mint) may be blended with viscose spinning solution for spinning into a fiber product. The fiber product may include, for example, a mint-containing composite cellulose fiber.

Generally, mint belongs to a family of flowering plants Lamiaceae and is mainly made of volatile menthol and may include non-volatile chemical components. Menthol provides unique mint scent. The major non-volatile chemical components may include emodin, rhubarb, physcion, anthranilic acid, sitosterol, aloe emodin, daucosterol, ursolic acid, and/or trans-cinnamic acid, and may provide the mint with basic efficacies, such as, coolness, refreshing, antibacterium, and/or anti-inflammation.

The fiber product containing mint-extract may have pharmacological effects of the mint including coolness, soothing, and refreshing, and may also have natural antibacterial capabilities. The fiber product may further have desirable bacteriostatic activity against *Staphylococcus aureus, Escherichia coli*, and/or *Candida albicans*. The fiber product may have a logarithm value of bacteriostatic activity greater than 2.0, and a logarithm value of bactericidal activity greater than 0. In addition, the fiber product may maintain the antibacterial activity after repeatedly washing but still with a natural coolness sensation. More importantly, the fiber product does not rely on non-renewable resources (e.g., petroleum). The fiber product is a natural antibacterial textile material that can be degraded naturally after being disposed.

The present disclosure provides a mint-containing composite cellulose fiber, and production method thereof. For example, the mint-containing composite cellulose fiber may be an antibacterial, deodorant viscose fiber, produced to provide desired antibacterial effect, excellent deodorizing performance, and excellent contact coolness. In addition, the antibacterial, deodorant viscose fiber may be naturally safe and naturally degradable after being disposed. Further, the antibacterial, deodorant viscose fiber may have fiber strength that is significantly high. Even further, the raw material, i.e., the mint plant, can be fully utilized. By a purification process to remove crystalline impurities, a mint-viscose blend can maintain desired filtering property during production process, thereby reducing the chance of production halting caused by blocked viscose filter, and thereby improving production efficiency.

In various embodiments, the disclosed mint-containing composite cellulose fiber (also referred to as mint-containing composite viscose fiber) may include cellulose of about 85% to about 95% by weight of total mint-containing composite cellulose fiber and mint-extract of about 5% to about 15% by weight of total mint-containing composite cellulose fiber.

In various embodiments, the disclosed mint-containing composite cellulose fiber may have a dry breaking strength greater than about 2.0 cN/dtex, a wet breaking strength greater than about 1.1 cN/dtex, a dry breaking elongation greater than about 16%, a line density deviation of about ±7%, a whiteness of about 38% to about 48%, a bacteriostatic logarithm value greater than about 2.0, a bactericidal logarithm value greater than 0, and/or a coolness coefficient greater than about 0.20 W/cm$^2$.

The disclosed mint-containing composite cellulose fiber can be formed by following exemplary steps.

1. Preparation of the Mint-Extract Crude Solution

1) Water extraction: whole mint plants that have been stored for less than six months are introduced (e.g., uniformly introduced) into a wear-resistant ceramic pulverizer. Vertical and horizontal shear forces are repeatedly applied to fibrillate and pulverize fibers of the whole mint plants into coarse powders. The coarse powders may have an average size of about 2 mm to about 3 mm. Then the coarse powders are poured into an extraction tank.

Water (e.g., having a temperature of about 40° C.-50° C.) of about 3 to about 5 times by weight of the coarse powders is added into the extraction tank to mix with the coarse powders for pre-treatment. The stirring speed in the extraction tank is adjusted to about 40 rpm to about 60 rpm (revolution per minute) for about 30 minutes to about 40 minutes. After the water for pre-treatment is drained and spin-dried, a water extraction process is performed.

For the water extraction process, water of about 7 to about 9 times by weight of the coarse powders is added into the extraction tank to mix with pre-treated coarse powders. Such mixture is then impregnated for about 80 minutes to about 100 minutes. Steam is introduced into the extraction tank to increase the temperature to be about 100° C. After decocting for about 2 hours to about 3 hours, the decocted solution can be filtered to provide first filtered residues and a first filtrate containing extracted mint (or mint components). The first filtrate is then stored in a reservoir tank.

Then, water of about 5 to about 7 times by weight of the first filtered residues is added into the extraction tank and mixed with the first filtered residues. Steam is introduced into the extraction tank to increase the temperature to about 100° C. After decocting for about 3 hours to about 4 hours, the decocted solution can be filtered for another time to provide second filtered residues and a second filtrate containing further-extracted mint. The second filtrate is also stored in the same reservoir tank and combined with the first filtrate in the reservoir tank. Note that the second filtered residues are obtained from processing of the first filtered residues.

In one embodiment, the second filtered residues may have less amount of the first filtered residues. In another embodiment, the water extraction process may be performed for a number of times as desired.

2) Ethanol extraction: ethanol of about 2 to about 4 times by weight of the second filtered residues is then added into the extraction tank and mixed with the second filtered residues for ethanol extraction. After impregnating for about 40 minutes to about 60 minutes, the temperature is raised to about 30° C. to about 40° C. and maintained for about 2 hours to about 3 hours. A filtering process is followed to provide third filtered residues and an ethanol-containing filtrate. Then the ethanol-containing filtrate is distilled to recycle or remove ethanol (e.g., at least until no ethanol-related smell is detected) to provide a third filtrate, e.g., an ethanol-free filtrate, which can be poured into the same reservoir tank and combined with the first and second filtrates. The combination of the first, second, and third filtrates can then provide a mint-extract crude solution, e.g., containing mint-extract (or extracted mint) with a concentration of about 25% to about 35% by weight of the total solution. In various embodiments, the ethanol extraction process may be performed for a number of times as desired.

2. Preparation of Mint-Extract Stock Solution

1) Such mint-extract crude solution can be treated by increasing a temperature to about 100° C. and maintained at this temperature for about 1 hour to about 2 hours. The temperature of the mint-extract crude solution is then quickly reduced (e.g., quenched) to about 10±2° C. within 30 minutes. Crystal substances in the mint-extract crude solution can be filtered out, e.g., using a 200-mesh filtration cloth. The treated (or filtered) mint-extract crude solution can then be ready to use.

2) In the extraction tank containing the treated/filtered mint-extract crude solution, an antifoaming agent (e.g., polydimethylsiloxane, having a weight of about 0.01 wt % to about 0.1 wt % of a dry mass of the mint-extract in the treated mint-extract crude solution) is added and mixed with the treated/filtered mint-extract crude solution, which are stirred for about 20 minutes to about 40 minutes at a speed of about 30 rpm to about 90 rpm. Such mixture can then be transferred into a defoaming bucket and defoamed to obtain a mint-extract stock solution.

3. Preparation of Viscose Spinning Solution

The mint-extract residues, such as the above-described third filtered residues obtained after the water extraction process(es) and the ethanol extraction process(es), can be used as raw materials to make pulp (or dissolving pulp). The pulp made by mint-extract residues is mixed with one or more pulps of cotton, wood, and bamboo pulps at a ratio of about 1:3 to about 1:6 by weight, followed by steps including impregnation, squeezing, crushing, aging, xanthation, and dissolving, to obtain a viscose spinning solution.

In the above impregnation step, an impregnation surfactant of about 0.01% to about 0.02% by weight of cellulose (e.g., α-cellulose) in the viscose solution can be added. In the above crushing step, a crush denaturing agent of about 0.02 to about 0.03% by weight of the cellulose in the viscose solution can be added. In the above dissolving step, a dissolution denaturing agent of about 1.0% to about 2.0% by weight of the cellulose in the viscose solution can be added and dissolved for about 1 hour to about 2 hours.

Further, after mixing, filtering, defoaming, and maturing, a high quality modified viscose spinning solution can be obtained. The high quality modified viscose spinning solution may have, e.g., a fiber (e.g., including α-cellulose) concentration of about 9.0±0.2% by weight, an alkali concentration of about 4.80±0.2% by weight, a viscosity of about 50.0±5 s/cm$^2$, a degree of maturation with 10% ammonium chloride value of about 14.0±2 mL, and/or a filtration resistance constant Kw of about 100 or less.

4. Preparation of Mint-Viscose Blend

Through a pre-spinning injection system, the mint-extract stock solution can be added into a dynamic mixer through a metering pump. The mint-extract stock solution may be added in an amount such that the mint (or extracted mint) powder therein has a ratio with the finally produced fiber product (i.e., the mint-containing composite cellulose fiber) for about 10% to about 20% by weight.

At the same time, the modified viscose solution can be added into the dynamic mixer through a viscose flowmeter. The mint-extract stock solution and the modified viscose spinning solution can then be well mixed to provide a mint-viscose blend.

5. Spinning and Post Treatment

The prepared mint-viscose blend can be filtered, spun, and introduced into a coagulation bath for forming fiber products. The coagulation bath includes about 70 g/L to about 120 g/L of sulfuric acid, about 4 g/L to about 8 g/L of aluminum sulfate, and about 320 g/L to about 350 g/L of sodium sulfate, and the temperature can be at about 40° C. to about 60° C. Then the mint-containing composite cellulose fiber can be obtained through fiber drawing processes and post treatment.

In one embodiment, in the above step 3 for preparing viscose spinning solution, the impregnation surfactant used in step 3 for preparing viscose spinning solution can be hydrophilic anionic surfactants such as, sulfonated castor oil and/or alkyl ammonium polyoxyethylene glycol; the crush denaturing agent can be, e.g., polyoxyethylene glycol ethers, and/or hydroxyethyl aliphatic amine; and the dissolution denaturing agent in the dissolving step can be, e.g., polyethylene glycol 1500 and/or urea.

In one embodiment, in the above step 5 of spinning into fiber products, a fiber drawing process can be conducted having about 20% to about 15% nozzle draw, about 20% to about 45% disc draw, and about 5% to about 20% plasticizing bath draw.

In one embodiment, the post treatment in step 5 can include: cutting, a first water washing, desulfurizing, a second water washing, and oil treating of the produced fiber product. In one embodiment, in the desulfurizing step, a desulfurizing bath having about 2 g/L to about 6 g/L of sodium sulfite at about 30° C. to about 60° C. can be used.

The mint-containing composite cellulose fiber of present disclosure can have less loss of the active ingredients of mint, and the final fiber product can have stable antibacterial property, obvious deodorizing effect, high coolness coefficient, and refreshing and long lasting mint scent. Therefore, the mint-containing composite cellulose fiber can have the advantages of the natural cellulose, such as, e.g., absorbing and permeable, comfortable, naturally degradable after being disposed, and the advantages of the functional fiber such as strong, long lasting and broad-spectrum antibacterial activity.

In addition, the production method of the present disclosure of mint-containing composite cellulose fiber can include progressive water extraction and ethanol extraction, and can prepare viscose fiber directly after quenching and crystallizing to remove impurities, thereby reducing the energy consumption of pelletization and transportation cost, and shortening the production process. The mint plant residues after extraction can be used as raw material for cellulose, thereby maximizing the use of the renewable resources and avoiding the waste and the environmental pollution problems caused by the disposables.

Further, the production method of the present disclosure of mint-containing composite cellulose fiber can have high content of organic substance such as, pentose and pectin, in the mint-extract stock solution. Therefore, it can be prone to bubbles and produce bubble fibers and rough fibers in the subsequent spinning process. Accordingly, after multiple pilot tests, the type and amount of the defoaming agents can be determined, thereby greatly improving the physical and mechanical properties of the mint-containing composite cellulose fiber.

Further, the production method of the present disclosure of mint-containing composite cellulose fiber can have a pre-spinning injection system designed for the active ingredients of the mint, thereby avoiding the excessive damage of the active ingredients caused by strong acid, strong base, and high temperature, and thereby reducing the consumption. The produced mint-containing composite cellulose fiber can have better textile production and clothing properties.

The plant residues of the mint pulp can have its structural characteristics such as, high contents of pentose and pectin, tight structure and stiff touch feeling. To better improve the touch feeling of the final fiber, the present disclosure adjusts the production process according to the following.

1) Suitable impregnation surfactant is selected and added in the impregnation step to modify the property of the contacting surface between the mint pulp and the alkaline solution so that the pulp can be quickly and uniformly impregnated by the alkaline solution, and to prevent flocculation and agglomeration of the alkali cellulose. After impregnating and squeezing, the alkali cellulose, under the same crushing conditions, can have more significantly fluffy volume. As a result, the density of the alkali cellulose after crushing can be about 11.80% to about 19.53% weight lighter than those alkali cellulose that have not been treated with impregnation surfactant. This facilitates filtering performance of the prepared viscose solution.

2) Suitable crush surfactant is selected and added in the crush step to prevent agglomeration of the mint pulp and alkali cellulose, and to improve the crushing degree and uniformity of the alkali cellulose. The use of crush surfactant can also facilitate the diffusion of carbon disulfide to the alkali cellulose chunks so as to infiltrate into the reaction region, thereby improving the distributional uniformity of the xanthic acid groups so that the cellulose xanthate can have improved solubility. At the same time, the viscosity of the cellulose xanthate can be reduced, thereby reducing the load of the xanthation machine and power consumption. Table 1 lists exemplary surfactants.

TABLE 1

| Surfactant name | Surfactant amount (with respect to alpha cellulose) | Average power consumption (kwh/batch) |
|---|---|---|
| Sulfonated castor oil | 0.13 | 101.2 |
| Alkyl ammonium polyoxyethylene glycol | 0.13 | 101.1 |
| Glycol fatty acid esters | 0.13 | 109.5 |
| Sorbitan trioleate | 0.13 | 110.3 |
| Polyethylene glycol dioleate | 0.13 | 115.4 |

3) Suitable dissolution denaturing agent is selected and added in the dissolving step to form a semi-permeable membrane layer on surface of viscose fibers when the viscose fibers are being formed. Such semi-permeable membrane layer can inhibit diffusion of hydrogen ions without impeding the penetration of aluminum ions, resulting in increase of the residual xanthates in fibers and increase of proportion of the skin layer of fibers, thereby improving the strength of the mint-containing composite fibers.

In various embodiments, in addition to the mint-extract, extract of other additive(s) may be included to form the mint-containing composite cellulose fibers. These additive(s) may include one or more of chloranthus glaber, apocynum, tuckahoe, isatis root, and wormwood. For example, raw materials of these additive(s) may be mixed with whole mint plants, to provide responsive extracted material(s) with mint-extract by going through the disclosed processes, e.g., including preparation of the mint-extract crude solution, preparation of mint-extract stock solution, preparation of viscose spinning solution, preparation of mint-viscose blend, and/or spinning and post treatment. The formed mint-containing composite cellulose fibers can then further include extracted chloranthus glaber, apocynum, tuckahoe, isatis root, and/or wormwood.

Exemplary Embodiment 1: Mint-Containing Composite Cellulose Fibers (1.33 dtex×38 mm)

Whole mint plants that have been stored for less than six months are introduced (e.g., uniformly introduced) into a wear-resistant ceramic pulverizer. Vertical and horizontal shear forces are repeatedly applied to fibrillate and pulverize fibers of the whole mint plants into coarse powders. The coarse powders may have an average size of about 2 mm to about 3 mm. Then the coarse powders are poured into an extraction tank.

Water (e.g., having a temperature of about 43° C.) of about 4 times by weight of the coarse powders is added into the extraction tank to mix with the coarse powders for pre-treatment. The stirring speed in the extraction tank is adjusted to be about 58 rpm (revolution per minute) for about 40 minutes. After the water for pre-treatment is drained and spin-dried, a water extraction process is performed.

For the water extraction process, water of about 8 times by weight of the coarse powders is added into the extraction tank to mix with the pre-treated coarse powders. Such mixture is then impregnated for about 90 minutes. Steam is introduced into the extraction tank to increase the temperature to be about 100° C. After decocting for about 2.5 hours, the decocted solution can be filtered to provide first filtered residues and a first filtrate containing extracted mint components from a first water extraction process. The first filtrate from the first water extraction process is then stored in a reservoir tank.

Then, water of about 6 times by weight of the first filtered residues is added into the extraction tank and mixed with the first filtered residues. Steam is introduced into the extraction tank to increase the temperature to be about 100° C. After decocting for about 3 hours, the decocted solution can be filtered to provide second filtered residues and a second filtrate containing further-extracted mint (components) from a second water extraction process. The second filtrate from the second water extraction process is also stored in the same reservoir tank and combined with the first filtrate in the same reservoir tank.

An ethanol extraction process is then performed. Ethanol of about 3 times by weight of the second filtered residues is then added into the extraction tank and mixed with the second filtered residues for the ethanol extraction process. After impregnating for about 50 minutes, the temperature is raised to about 40° C. and maintained for about 3 hours. A filtering process is followed to provide third filtered residues and an ethanol-containing filtrate. Then the ethanol-containing filtrate is distilled to recycle or otherwise remove the ethanol (e.g., until no ethanol-related smell is detected) to provide a third filtrate, e.g., an ethanol-free filtrate, which can be added into the same reservoir tank and combined with the first and second filtrates.

The combination of the first, second, and third filtrates can then be a mint-extract crude solution, e.g., containing mint-extract (or extracted mint components) with a concentration of about 30.2% by weight of the total solution.

Such mint-extract crude solution can be treated by increasing a temperature to be about 100° C. and maintained at this temperature for about 2 hours. The temperature of the mint-extract crude solution is then quickly reduced (e.g., quenched) to about 9° C. within 30 minutes. Crystal substances in the mint-extract crude solution can be filtered out, e.g., using a 200-mesh filtration cloth. The treated mint-extract crude solution can then be ready to use.

For example, in the extraction tank containing the treated mint-extract crude solution, an antifoaming agent (e.g., polydimethylsiloxane, having a weight of about 0.02 wt % of a dry mass of the mint-extract in the treated mint-extract crude solution) is added and mixed with the treated mint-extract crude solution, which together are stirred for about 30 minutes at a speed of about 60 rpm. Such mixture can then be transferred into a defoaming bucket and defoamed to obtain a mint-extract stock solution.

The mint-extract residues, i.e., the above-described third filtered residues obtained after the first and second water extraction processes and the ethanol extraction process, can be used as raw materials to make a pulp (or dissolving pulp). The pulp made by mint-extract residues is mixed with cotton pulp at a ratio of 1:4 by weight, followed by steps including impregnation, squeezing, crushing, aging, xanthation, and dissolving, to obtain a viscose solution.

In those exemplary steps, various additives can be added accordingly. For example, in the above impregnation step, an impregnation surfactant (e.g., alkyl ammonium polyoxyethylene glycol) of about 0.01% by weight of the exemplary a cellulose in the viscose can be included. In the above crushing step, a crush denaturing agent (e.g., polyoxyethylene glycol) of about 0.03% by weight of the α cellulose in the viscose can be added. In the above dissolving step, a dissolution denaturing agent (e.g., polyethylene glycol 1500) of about 2.0% by weight of the α cellulose in the viscose can be added and dissolved for about 2 hours.

Further, steps for mixing, filtering, defoaming, and maturing can be performed to provide a high quality modified viscose solution. The high quality modified viscose solution may have, e.g., a fiber concentration of about 8.9%, an alkali concentration of about 4.80%, a viscosity of about 48 s/cm$^2$, a degree of maturing of about 13 mL (10% ammonium chloride), and a filtration resistance constant Kw of about 100 or less.

Through a pre-spinning injection system, the mint-extract stock solution can be added into a dynamic mixer through a metering pump. The mint-extract stock solution may be added in an amount such that the mint powder (or extracted mint components) therein has a weight ratio with the final fiber product for about 12%. At the same time, the modified viscose solution can be added into the dynamic mixer through a viscose flowmeter. The mint-extract stock solution and the modified viscose solution can then be well mixed to provide a mint-viscose blend.

The prepared mint-viscose blend can be filtered, spun, and introduced into a coagulation bath for forming fiber products. The coagulation bath includes about 100.5 g/L of sulfuric acid, about 4.9 g/L of aluminum sulfate, and about 330 g/L of sodium sulfate, and the temperature can be at about 49° C. A fiber drawing process can be conducted of about 10% nozzle draw, about 21% disc draw, and about 10.6% plasticizing bath draw. This can be followed by further processes including cutting, water washing, desulfurizing (in a desulfurizing bath having about 4.3 g/L of sulfite at about 41° C.), water washing, and oil treating. Mint-containing composite cellulose fiber can then be obtained.

Note that, no bleaching treatments are used when producing the disclosed mint-containing composite cellulose fiber. This can ensure the fiber's natural properties and antibacterial activities.

As such, mint-containing composite cellulose fibers, e.g., about 1.33 dtex×38 mm, may be produced according to the exemplary Embodiment 1. Quality measurements may then be performed. The measuring results of major items are listed in Table 2. In this exemplary table, note that the bacteriostatic and bactericidal values were measured according to Japanese Industrial Standard JIS L1902:2008. Coolness coefficient is the sense of coolness upon instant contact (Q-max). The instrument used is a thermal effects analyzer (KES-F7 THERMO LABOII).

TABLE 2

| Mint-extract (%) | Dry strength (cN/dtex) | Wet strength (cN/dtex) | Dry breaking elongation (%) | | |
|---|---|---|---|---|---|
| 11.3 | 2.10 | 1.16 | 17.2 | | |
| Line density deviation (%) | Bactericidal logarithm value | Bacteriostatic logarithm value | Coolness coefficient (W/cm$^2$) | Whiteness (%) | |
| 3.2 | 1.8 | 3.7 | 0.39 | 42 | |

Exemplary Embodiment 2: Mint-Containing Composite Cellulose Fibers (1.67 dtex×38 mm)

Whole mint plants that have been stored for less than six months are introduced (e.g., uniformly introduced) into a wear-resistant ceramic pulverizer. Vertical and horizontal shear forces are repeatedly applied to fibrillate and pulverize fibers of the whole mint plants into coarse powders. The coarse powders may have an average size of about 2 mm to about 3 mm. Then the coarse powders are poured into an extraction tank.

Water (e.g., having a temperature of about 50° C.) of about 3.1 times by weight of the coarse powders is added into the extraction tank to mix with the coarse powders for pre-treatment. The stirring speed in the extraction tank is adjusted to about 40 rpm (revolution per minute) for about 35 minutes. After the water for pre-treatment is drained and spin-dried, a water extraction process is performed.

For the water extraction process, water of about 7 times by weight of the coarse powders is added into the extraction tank to mix with pre-treated coarse powders. Such mixture is then impregnated for about 80 minutes. Steam is introduced into the extraction tank to increase the temperature to be about 100° C. After decocting for about 3 hours, the decocted solution can be filtered to provide first filtered residues and a first filtrate containing extracted mint components. The first filtrate is then stored in a reservoir tank.

Then, water of about 5 times by weight of the first filtered residues is added into the extraction tank and mixed with the first filtered residues. Steam is introduced into the extraction tank to increase the temperature to about 100° C. After decocting for about 4 hours, the decocted solution can be filtered for another time to provide second filtered residues and a second filtrate containing further-extracted mint components. The second filtrate is also stored in the same reservoir tank and combined with the first filtrate in the reservoir tank.

An ethanol extraction is then performed. Ethanol of about 3.5 times by weight of the second filtered residues is then added into the extraction tank and mixed with the second filtered residues for ethanol extraction. After impregnating for about 40 minutes, the temperature is raised to about 35° C. and maintained for about 2 hours. A filtering process is followed to provide third filtered residues and an ethanol-containing filtrate. Then the ethanol-containing filtrate is distilled to recycle or remove ethanol (e.g., until no ethanol-related smell is detected) to provide a third filtrate, e.g., an ethanol-free filtrate, which can be poured into the same reservoir tank and combined with the first and second filtrates.

The combination of the first, second, and third filtrates can then provide a mint-extract crude solution, e.g., containing mint-extract (or extracted mint) with a concentration of about 25.9% by weight of the total solution.

Such mint-extract crude solution can be treated by increasing a temperature to about 100° C. and maintained at this temperature for about 1 hour. The temperature of the mint-extract crude solution is then quickly reduced (e.g., quenched) to about 12° C. within 30 minutes. Crystal substances in the mint-extract crude solution can be filtered out, e.g., using a 200-mesh filtration cloth. The treated mint-extract crude solution can then be ready to use.

For example, in the extraction tank containing the treated mint-extract crude solution, an antifoaming agent (e.g., polydimethylsiloxane, having a weight of about 0.09 wt % of a dry mass of the mint-extract in the treated mint-extract crude solution) is added and mixed with the treated mint-extract crude solution, which are stirred for about 20 minutes at a speed of about 30 rpm. Such mixture can then be transferred into a defoaming bucket and defoamed to obtain a mint-extract stock solution.

The mint-extract residues, such as the above-described third filtered residues obtained after the water extraction processes and the ethanol extraction process, can be used as raw materials to make pulp (or dissolving pulp). The pulp made by mint-extract residues is mixed with wood pulp at a ratio of 1:3 by weight, followed by steps including impregnation, squeezing, crushing, aging, xanthation, and dissolving, to obtain a viscose solution.

For example, in the above impregnation step, an impregnation surfactant (e.g., sulfonated castor oil) of about 0.02% by weight of the α cellulose in the viscose can be added. In the above crushing step, a crush denaturing agent (e.g., hydroxyethyl aliphatic amine) of about 0.02% by weight of the α cellulose in the viscose can be added. In the above dissolving step, a dissolution denaturing agent (e.g., urea) of about 1.8% by weight of the α cellulose in the viscose can be added and dissolved for about 1.5 hours.

Further, after mixing, filtering, defoaming, and maturing, a high quality modified viscose solution can be obtained. The high quality modified viscose solution may have, e.g., a fiber concentration of about 9.1%, an alkali concentration of about 4.90%, a viscosity of about 53 s/cm2, a degree of maturing of about 12 mL (10% ammonium chloride), and a filtration resistance constant Kw of about 100 or less.

Through a pre-spinning injection system, the mint-extract stock solution can be added into a dynamic mixer through a metering pump. The mint-extract stock solution may be added in an amount such that the mint (or extracted mint) powder therein has a ratio with the final fiber product for about 5% by weight. At the same time, the modified viscose solution can be added into the dynamic mixer through a viscose flowmeter. The mint-extract stock solution and the modified viscose solution can then be well mixed to provide a mint-viscose blend.

The prepared mint-viscose blend can be filtered, spun, and introduced into a coagulation bath for forming fiber products. The coagulation bath includes about 70 g/L of sulfuric acid, 8 g/L of aluminum sulfate, and 350 g/L of sodium sulfate, and the temperature can be at about 60° C. A fiber drawing process can be conducted having about 19% nozzle draw, about 35% disc draw, and about 20% plasticizing bath draw. This can be followed by further processes including cutting, water washing, desulfurizing (in a desulfurizing bath having about 5.8 g/L of sulfite at about 60° C.), water washing, and oil treating. Mint-containing composite cellulose fiber can then be obtained.

Note that, no bleaching treatments are used when producing the disclosed mint-containing composite cellulose fiber, to ensure the fiber's natural properties and antibacterial activities.

In one embodiment, mint-containing composite cellulose fibers, e.g., about 1.67 dtex×38 mm, may be produced according to the exemplary Embodiment 2. Quality measurements may then be performed. The measuring results of major items are listed in Table 3. In this exemplary table, note that the bacteriostatic and bactericidal values were measured according to Japanese Industrial Standard JIS L1902:2008. Coolness coefficient is the sense of coolness upon instant contact (Q-max). The instrument used is a thermal effects analyzer (KES-F7 THERMO LABOII).

TABLE 3

| Mint-extract (%) | Dry strength (cN/dtex) | Wet strength (cN/dtex) | Dry breaking elongation (%) | | |
|---|---|---|---|---|---|
| 5 | 2.49 | 1.43 | 18.1 | | |
| Line density deviation (%) | Bactericidal logarithm value | Bacteriostatic logarithm value | Coolness coefficient ($W/cm^2$) | Whiteness (%) | |
| −4.4 | 0.3 | 2.8 | 0.27 | 48 | |

Exemplary Embodiment 3: Mint-Containing Composite Cellulose Fibers (2.22 dtex×38 mm)

Whole mint plants that have been stored for less than six months are introduced (e.g., uniformly introduced) into a wear-resistant ceramic pulverizer. Vertical and horizontal shear forces are repeatedly applied to fibrillate and pulverize fibers of the whole mint plants into coarse powders. The coarse powders may have an average size of about 2 mm to about 3 mm. Then the coarse powders are poured into an extraction tank.

Water (e.g., having a temperature of about 40° C.) of about 5 times by weight of the coarse powders is added into the extraction tank to mix with the coarse powders for pre-treatment. The stirring speed in the extraction tank is adjusted to about 32 rpm (revolution per minute) for about 30 minutes. After the water for pre-treatment is drained and spin-dried, a water extraction process is performed.

For the water extraction process, water of about 9 times by weight of the coarse powders is added into the extraction tank to mix with pre-treated coarse powders. Such mixture is then impregnated for about 100 minutes. Steam is introduced into the extraction tank to increase the temperature to be about 100° C. After decocting for about 2.6 hours, the decocted solution can be filtered to provide first filtered residues and a first filtrate containing extracted mint components. The first filtrate is then stored in a reservoir tank.

Then, water of about 7 times by weight of the first filtered residues is added into the extraction tank and mixed with the first filtered residues. Steam is introduced into the extraction tank to increase the temperature to about 100° C. After decocting for about 3.5 hours, the decocted solution can be filtered for another time to provide second filtered residues and a second filtrate containing further-extracted mint components. The second filtrate is also stored in the same reservoir tank and combined with the first filtrate in the reservoir tank.

An ethanol extraction is then performed. Ethanol of about 2 times by weight of the second filtered residues is then added into the extraction tank and mixed with the second filtered residues for ethanol extraction. After impregnating for about 50 minutes, the temperature is raised to about 40° C. and maintained for about 3 hours. A filtering process is followed to provide third filtered residues and an ethanol-containing filtrate. Then the ethanol-containing filtrate is distilled to recycle or remove ethanol (e.g., until no ethanol-related smell is detected) to provide a third filtrate, e.g., an ethanol-free filtrate, which can be poured into the same reservoir tank and combined with the first and second filtrates.

The combination of the first, second, and third filtrates can then provide a mint-extract crude solution, e.g., containing mint-extract (or extracted mint) with a concentration of about 25.1% by weight of the total solution.

Such mint-extract crude solution can be treated by increasing a temperature to about 100° C. and maintained at this temperature for about 1.5 hours. The temperature of the mint-extract crude solution is then quickly reduced (e.g., quenched) to about 8° C. within 30 minutes. Crystal substances in the mint-extract crude solution can be filtered out, e.g., using a 200-mesh filtration cloth. The treated mint-extract crude solution can then be ready to use.

For example, in the extraction tank containing the treated mint-extract crude solution, an antifoaming agent (e.g., polydimethylsiloxane, having a weight of about 0.01 wt % of a dry mass of the mint-extract in the treated mint-extract crude solution) is added and mixed with the treated mint-extract crude solution, which are stirred for about 40 minutes at a speed of about 50 rpm. Such mixture can then be transferred into a defoaming bucket and defoamed to obtain a mint-extract stock solution.

The mint-extract residues, such as the above-described third filtered residues obtained after the water extraction processes and the ethanol extraction process, can be used as raw materials to make pulp (or dissolving pulp). The pulp made by mint-extract residues is mixed with bamboo pulp at a ratio of 1:6 by weight, followed by steps including impregnation, squeezing, crushing, aging, xanthation, and dissolving, to obtain a viscose solution.

For example, in the above impregnation step, an impregnation surfactant (e.g., sulfonated castor oil) of about 0.01% by weight of the α cellulose in the viscose can be added. In the above crushing step, a crush denaturing agent (e.g., aliphatic alcohol polyoxyethylene glycol) of about 0.04% by weight of the α cellulose in the viscose can be added. In the above dissolving step, a dissolution denaturing agent (e.g., urea) of about 1.0% by weight of the α cellulose in the viscose can be added and dissolved for about 2 hours.

Further, after mixing, filtering, defoaming, and maturing, a high quality modified viscose solution can be obtained. The high quality modified viscose solution may have, e.g., a fiber concentration of about 8.8%, an alkali concentration of about 4.62%, a viscosity of about 45 s/cm2, a degree of maturing of about 16 mL (10% ammonium chloride), and a filtration resistance constant Kw of about 100 or less.

Through a pre-spinning injection system, the mint-extract stock solution can be added into a dynamic mixer through a metering pump. The mint-extract stock solution may be added in an amount such that the mint (or extracted mint) powder therein has a ratio with the final fiber product for about 8% by weight. At the same time, the modified viscose solution can be added into the dynamic mixer through a viscose flowmeter. The mint-extract stock solution and the modified viscose solution can then be well mixed to provide a mint-viscose blend.

The prepared mint-viscose blend can be filtered, spun, and introduced into a coagulation bath for forming fiber products. The coagulation bath includes about 112 g/L of sulfuric acid, 6.2 g/L of aluminum sulfate, and 326 g/L of sodium sulfate, and the temperature can be at about 49° C. A fiber drawing process can be conducted having about 15% nozzle draw, about 28% disc draw, and about 12.3% plasticizing bath draw. This can be followed by further processes including cutting, water washing, desulfurizing (in a desulfurizing bath having about 4.6 g/L of sulfite at about 43° C.), water washing, and oil treating. Mint-containing composite cellulose fiber can then be obtained.

Note that, no bleaching treatments are used when producing the disclosed mint-containing composite cellulose fiber, to ensure the fiber's natural properties and antibacterial activities.

In one embodiment, mint-containing composite cellulose fibers, e.g., about 2.22 dtex×38 mm, may be produced according to the exemplary Embodiment 3. Quality measurements may then be performed. The measuring results of major items are listed in Table 4. In this exemplary table, note that the bacteriostatic and bactericidal values were measured according to Japanese Industrial Standard JIS L1902:2008. Coolness coefficient is the sense of coolness upon instant contact (Q-max). The instrument used is a thermal effects analyzer (KES-F7 THERMO LABOII).

TABLE 4

| Mint-extract (%) | Dry strength (cN/dtex) | Wet strength (cN/dtex) | Dry breaking elongation (%) | |
|---|---|---|---|---|
| 7.91 | 2.23 | 1.24 | 17.8 | |
| Line density deviation (%) | Bactericidal logarithm value | Bacteriostatic logarithm value | Coolness coefficient ($W/cm^2$) | Whiteness (%) |
| −1.1 | 1.2 | 3.4 | 0.32 | 43.2 |

Exemplary Embodiment 4: Mint-Containing Composite Cellulose Fibers (2.78 dtex×51 mm)

Whole mint plants that have been stored for less than six months are introduced (e.g., uniformly introduced) into a wear-resistant ceramic pulverizer. Vertical and horizontal shear forces are repeatedly applied to fibrillate and pulverize fibers of the whole mint plants into coarse powders. The coarse powders may have an average size of about 2 mm to about 3 mm. Then the coarse powders are poured into an extraction tank.

Water (e.g., having a temperature of about 45° C.) of about 3.6 times by weight of the coarse powders is added into the extraction tank to mix with the coarse powders for pre-treatment. The stirring speed in the extraction tank is adjusted to about 50 rpm (revolution per minute) for about 35 minutes. After the water for pre-treatment is drained and spin-dried, a water extraction process is performed.

For the water extraction process, water of about 7.2 times by weight of the coarse powders is added into the extraction tank to mix with pre-treated coarse powders. Such mixture is then impregnated for about 92 minutes. Steam is introduced into the extraction tank to increase the temperature to be about 100° C. After decocting for about 2.1 hours, the decocted solution can be filtered to provide first filtered residues and a first filtrate containing extracted mint components. The first filtrate is then stored in a reservoir tank.

Then, water of about 6.1 times by weight of the first filtered residues is added into the extraction tank and mixed with the first filtered residues. Steam is introduced into the extraction tank to increase the temperature to about 100° C. After decocting for about 4 hours, the decocted solution can be filtered for another time to provide second filtered residues and a second filtrate containing further-extracted mint components. The second filtrate is also stored in the same reservoir tank and combined with the first filtrate in the reservoir tank.

An ethanol extraction is then performed. Ethanol of about 3.1 times by weight of the second filtered residues is then added into the extraction tank and mixed with the second filtered residues for ethanol extraction. After impregnating for about 45 minutes, the temperature is raised to about 35° C. and maintained for about 2.3 hours. A filtering process is followed to provide third filtered residues and an ethanol-containing filtrate. Then the ethanol-containing filtrate is distilled to recycle or remove ethanol (e.g., until no ethanol-related smell is detected) to provide a third filtrate, e.g., an ethanol-free filtrate, which can be poured into the same reservoir tank and combined with the first and second filtrates.

The combination of the first, second, and third filtrates can then provide a mint-extract crude solution, e.g., containing mint-extract (or extracted mint) with a concentration of about 34.9% by weight of the total solution.

Such mint-extract crude solution can be treated by increasing a temperature to about 100° C. and maintained at this temperature for about 1 hour. The temperature of the mint-extract crude solution is then quickly reduced (e.g., quenched) to about 11° C. within 30 minutes. Crystal substances in the mint-extract crude solution can be filtered out, e.g., using a 200-mesh filtration cloth. The treated mint-extract crude solution can then be ready to use.

For example, in the extraction tank containing the treated mint-extract crude solution, an antifoaming agent (e.g., polydimethylsiloxane, having a weight of about 0.07 wt % of a dry mass of the mint-extract in the treated mint-extract crude solution) is added and mixed with the treated mint-extract crude solution, which are stirred for about 30 minutes at a speed of about 90 rpm. Such mixture can then be transferred into a defoaming bucket and defoamed to obtain a mint-extract stock solution.

The mint-extract residues, such as the above-described third filtered residues obtained after the water extraction processes and the ethanol extraction process, can be used as raw materials to make pulp (or dissolving pulp). The pulp made by mint-extract residues is mixed with bamboo pulp at a ratio of 1:5 by weight, followed by steps including impregnation, squeezing, crushing, aging, xanthation, and dissolving, to obtain a viscose solution.

For example, in the above impregnation step, an impregnation surfactant (e.g., sulfonated castor oil:alkylammonium polyoxyethylene glycol=2:1) of about 0.01% by weight of the α cellulose in the viscose can be added. In the above crushing step, a crush denaturing agent (e.g., aliphatic alcohol polyoxyethylene glycol:hydroxyethyl aliphatic amine=1:1) of about 0.04% by weight of the α cellulose in the viscose can be added. In the above dissolving step, a dissolution denaturing agent (e.g., polyethylene glycol 1500) of about 1.0% by weight of the α cellulose in the viscose can be added and dissolved for about 1 hour.

Further, after mixing, filtering, defoaming, and maturing, a high quality modified viscose solution can be obtained. The high quality modified viscose solution may have, e.g., a fiber concentration of about 9.2%, an alkali concentration of about 5.00%, a viscosity of about 50 s/cm2, a degree of maturing of about 13.8 mL (10% ammonium chloride), and a filtration resistance constant Kw of about 100 or less.

Through a pre-spinning injection system, the mint-extract stock solution can be added into a dynamic mixer through a metering pump. The mint-extract stock solution may be added in an amount such that the mint (or extracted mint) powder therein has a ratio with the final fiber product for about 15% by weight. At the same time, the modified viscose solution can be added into the dynamic mixer through a viscose flowmeter. The mint-extract stock solution and the modified viscose solution can then be well mixed to provide a mint-viscose blend.

The prepared mint-viscose blend can be filtered, spun, and introduced into a coagulation bath for forming fiber products. The coagulation bath includes about 120 g/L of sulfuric acid, 7.9 g/L of aluminum sulfate, and 350 g/L of sodium sulfate, and the temperature can be at about 40° C. A fiber drawing process can be conducted having about 20% nozzle draw, about 40% disc draw, and about 5% plasticizing bath draw. This can be followed by further processes including cutting, water washing, desulfurizing (in a desulfurizing bath having about 2 g/L of sulfite at about 60° C.), water washing, and oil treating. Mint-containing composite cellulose fiber can then be obtained.

Note that, no bleaching treatments are used when producing the disclosed mint-containing composite cellulose fiber, to ensure the fiber's natural properties and antibacterial activities.

In one embodiment, mint-containing composite cellulose fibers, e.g., about 2.78 dtex×51 mm, may be produced according to the exemplary Embodiment 4. Quality measurements may then be performed. The measuring results of major items are listed in Table 5. In this exemplary table, note that the bacteriostatic and bactericidal values were measured according to Japanese Industrial Standard JIS L1902:2008. Coolness coefficient is the sense of coolness upon instant contact (Q-max). The instrument used is a thermal effects analyzer (KES-F7 THERMO LABOII).

TABLE 5

| Mint-extract (%) | Dry strength (cN/dtex) | Wet strength (cN/dtex) | Dry breaking elongation (%) | | |
|---|---|---|---|---|---|
| 14.91 | 2.02 | 1.11 | 16.2 | | |
| Line density deviation (%) | Bactericidal logarithm value | Bacteriostatic logarithm value | Coolness coefficient (W/cm$^2$) | Whiteness (%) | |
| −6.1 | 2.6 | 4.8 | 0.44 | 38 | |

Exemplary Embodiment 5: Mint-Containing Composite Cellulose Fibers (3.33 dtex×60 mm)

Whole mint plants that have been stored for less than six months are introduced (e.g., uniformly introduced) into a wear-resistant ceramic pulverizer. Vertical and horizontal shear forces are repeatedly applied to fibrillate and pulverize fibers of the whole mint plants into coarse powders. The coarse powders may have an average size of about 2 mm to about 3 mm. Then the coarse powders are poured into an extraction tank.

Water (e.g., having a temperature of about 48° C.) of about 5 times by weight of the coarse powders is added into the extraction tank to mix with the coarse powders for pre-treatment. The stirring speed in the extraction tank is adjusted to about 57 rpm (revolution per minute) for about 32 minutes. After the water for pre-treatment is drained and spin-dried, a water extraction process is performed.

For the water extraction process, water of about 8.5 times by weight of the coarse powders is added into the extraction tank to mix with pre-treated coarse powders. Such mixture is then impregnated for about 85 minutes. Steam is introduced into the extraction tank to increase the temperature to be about 100° C. After decocting for about 3 hours, the decocted solution can be filtered to provide first filtered residues and a first filtrate containing extracted mint components. The first filtrate is then stored in a reservoir tank.

Then, water of about 7 times by weight of the first filtered residues is added into the extraction tank and mixed with the first filtered residues. Steam is introduced into the extraction tank to increase the temperature to about 100° C. After decocting for about 3 hours, the decocted solution can be filtered for another time to provide second filtered residues and a second filtrate containing further-extracted mint components. The second filtrate is also stored in the same reservoir tank and combined with the first filtrate in the reservoir tank.

An ethanol extraction is then performed. Ethanol of about 2.2 times by weight of the second filtered residues is then added into the extraction tank and mixed with the second filtered residues for ethanol extraction. After impregnating for about 44 minutes, the temperature is raised to about 36° C. and maintained for about 2 hours. A filtering process is followed to provide third filtered residues and an ethanol-containing filtrate. Then the ethanol-containing filtrate is distilled to recycle or remove ethanol (e.g., until no ethanol-related smell is detected) to provide a third filtrate, e.g., an ethanol-free filtrate, which can be poured into the same reservoir tank and combined with the first and second filtrates.

The combination of the first, second, and third filtrates can then provide a mint-extract crude solution, e.g., containing mint-extract (or extracted mint) with a concentration of about 30.2% by weight of the total solution.

Such mint-extract crude solution can be treated by increasing a temperature to about 100° C. and maintained at this temperature for about 2 hours. The temperature of the mint-extract crude solution is then quickly reduced (e.g., quenched) to about 12° C. within 30 minutes. Crystal substances in the mint-extract crude solution can be filtered out, e.g., using a 200-mesh filtration cloth. The treated mint-extract crude solution can then be ready to use.

For example, in the extraction tank containing the treated mint-extract crude solution, an antifoaming agent (e.g., polydimethylsiloxane, having a weight of about 0.1 wt % of a dry mass of the mint-extract in the treated mint-extract crude solution) is added and mixed with the treated mint-extract crude solution, which are stirred for about 35 minutes at a speed of about 80 rpm. Such mixture can then be transferred into a defoaming bucket and defoamed to obtain a mint-extract stock solution.

The mint-extract residues, such as the above-described third filtered residues obtained after the water extraction processes and the ethanol extraction process, can be used as raw materials to make pulp (or dissolving pulp). The pulp made by mint-extract residues is mixed with cotton pulp at a ratio of 1:3 by weight, followed by steps including impregnation, squeezing, crushing, aging, xanthation, and dissolving, to obtain a viscose solution.

For example, in the above impregnation step, an impregnation surfactant (e.g., sulfonated castor oil:alkylammonium polyoxyethylene glycol=3:1) of about 0.01% by weight of the α cellulose in the viscose can be added. In the above crushing step, a crush denaturing agent (e.g., aliphatic alcohol polyoxyethylene glycol) of about 0.04% by weight of the α cellulose in the viscose can be added. In the above dissolving step, a dissolution denaturing agent (e.g., polyethylene glycol 1500:urea=2:1) of about 1.5% by weight of the α cellulose in the viscose can be added and dissolved for about 2 hours.

Further, after mixing, filtering, defoaming, and maturing, a high quality modified viscose solution can be obtained. The high quality modified viscose solution may have, e.g., a fiber concentration of about 9%, an alkali concentration of about 4.9%, a viscosity of about 46 s/cm2, a degree of maturing of about 12.0 mL (10% ammonium chloride), and a filtration resistance constant Kw of about 100 or less.

Through a pre-spinning injection system, the mint-extract stock solution can be added into a dynamic mixer through a metering pump. The mint-extract stock solution may be added in an amount such that the mint (or extracted mint) powder therein has a ratio with the final fiber product for about 6% by weight. At the same time, the modified viscose solution can be added into the dynamic mixer through a viscose flowmeter. The mint-extract stock solution and the modified viscose solution can then be well mixed to provide a mint-viscose blend.

The prepared mint-viscose blend can be filtered, spun, and introduced into a coagulation bath for forming fiber products. The coagulation bath includes about 90 g/L of sulfuric acid, 7.2 g/L of aluminum sulfate, and 320 g/L of sodium sulfate, and the temperature can be at about 54° C. A fiber drawing process can be conducted having about 0% nozzle draw, about 36% disc draw, and about 12% plasticizing bath draw. This can be followed by further processes including cutting, water washing, desulfurizing (in a desulfurizing bath having about 5.2 g/L of sulfite at about 41° C.), water washing, and oil treating. Mint-containing composite cellulose fiber can then be obtained.

Note that, no bleaching treatments are used when producing the disclosed mint-containing composite cellulose fiber, to ensure the fiber's natural properties and antibacterial activities.

In one embodiment, mint-containing composite cellulose fibers, e.g., about 3.33 dtex×60 mm, may be produced according to the exemplary Embodiment 5. Quality measurements may then be performed. The measuring results of major items are listed in Table 6. In this exemplary table, note that the bacteriostatic and bactericidal values were measured according to Japanese Industrial Standard JIS L1902:2008. Coolness coefficient is the sense of coolness upon instant contact (Q-max). The instrument used is a thermal effects analyzer (KES-F7 THERMO LABOII).

TABLE 6

| Mint-extract (%) | Dry strength (cN/dtex) | Wet strength (cN/dtex) | Dry breaking elongation (%) | |
|---|---|---|---|---|
| 5.96 | 2.12 | 1.21 | 19.2 | |
| Line density deviation (%) | Bactericidal logarithm value | Bacteriostatic logarithm value | Coolness coefficient ($W/cm^2$) | Whiteness (%) |
| 1.1 | 0.6 | 2.9 | 0.29 | 47 |

After testing the mint-containing composite cellulose fibers prepared in accordance to methods described in the exemplary Embodiments 1-5, the prepared cellulose fibers have dry breaking strength>2.0 cN/dtes, wet breaking strength>1.1 cN/dtex, dry breaking elongation>16%, line density deviation±7%, whiteness 38-48%, bacteriostatic logarithm value>2.0, bactericidal logarithm value>0, coolness coefficient>0.20 $W/cm^2$, and all of these meet the application requirements. In addition, although cellulose fibers prepared in accordance with exemplary Embodiments 1 to 5 have various specifications, analysis has shown that cellulose short fiber prepared according to exemplary Embodiment 3 has lower cost and the prepared cellulose fiber has high overall performance, thereby can be an optimal production method.

In the above exemplary embodiments, the preferred embodiments of the present disclosure have been described. Obviously, many variations can be made using the concept of the present disclosure. Here, it should be noted that any variation within the frame of the concept of the present disclosure will fall within the scope of the present disclosure.

INDUSTRIAL APPLICABILITY AND ADVANTAGEOUS EFFECTS

Without limiting the scope of any claim and/or the specification, examples of industrial applicability and certain advantageous effects of the disclosed embodiments are listed for illustrative purposes. Various alternations, modifications, or equivalents to the technical solutions of the disclosed embodiments can be obvious to those skilled in the art and can be included in this disclosure.

Mint-containing composite cellulose fibers fabricated in accordance with various disclosed embodiments not only have stable antibacterial properties, obvious deodorizing effect, high coolness coefficient, refreshing and long lasting mint scent, but also use natural plant components as the main raw materials. Meanwhile, in the disclosed method of producing the mint-containing composite cellulose fibers, there are provided rational utilization of textile auxiliaries, optimized processes, and improved quality of the viscose and filtration performance, thereby reducing energy consumption, greatly improving the spinnability, and improving production efficiency. Further, the disclosed mint-containing composite cellulose fibers and production methods thereof are suitable for high-volume (massive) industrial production. Mint-containing composite cellulose fibers fabricated in accordance with various disclosed embodiments can be blended with a variety of fibers such as, e.g., cotton, wool, linen, silk, Tencel, Modal, and/or bamboo fiber. They are suitable for textiles that are in close contact with human skin, such as, for underwear, bed sheets, blankets, socks, pillow covers, infant clothing, and/or nurse uniforms, thereby having broad market prospects.

What is claimed is:

1. A method for producing a mint-containing composite cellulose fiber, comprising:

fibrillating and pulverizing a whole mint plant into coarse powders;

performing a water extraction process on the coarse powders by:

mixing the coarse powders of the whole mint plant with water to form a mixture, introducing a steam into the mixture to prepare a decocted solution, and filtering the decocted solution to provide first filtered residue and a first filtrate containing extracted mint;

repeating the water extraction process on the first filtered residue to provide second filtered residue and a second filtrate;

performing an ethanol extraction process by:

mixing and impregnating the second filtered residue with ethanol to provide an ethanol-containing mixture, filtering the ethanol-containing mixture to provide third filtered residue and an ethanol-containing filtrate, and distilling the ethanol-containing filtrate to provide a third filtrate that is ethanol-free; and forming a mint-extract crude solution by mixing the first, second, and third filtrates together, wherein the mint-extract crude solution contains the extracted mint;

preparing a mint-extract stock solution containing the extracted mint by treating the mint-extract crude solution using at least a quenching process;

preparing a viscose spinning solution by mixing the third filtered residue containing mint-extract residue with one or more pulps, containing cellulose and selected from a cotton pulp, a wood pulp, a bamboo pulp, a wool pulp, a linen pulp, a silk pulp, a Tencel pulp, and a Modal pulp;

preparing a mint-viscose blend by dynamically mixing the mint-extract stock solution, containing the extracted mint, with the viscose spinning solution; and spinning the mint-viscose blend into the mint-containing composite cellulose fiber.

2. The method according to claim 1, wherein, the coarse powders having an average size of about 2 mm to about 3 mm.

3. The method according to claim 1, wherein the water extraction process further comprises:

introducing the steam into the mixture containing the coarse powders and the water to increase a temperature to be about 100° C. for decocting to prepare the decocted solution.

4. The method according to claim 1, wherein the quenching process comprises:

increasing a temperature of the mint-extract crude solution to be about 100° C. and maintained at the temperature for about 1 to about 2 hours, and quickly reducing the temperature to about 10° C. within about 30 minutes.

5. The method according to claim 1, wherein the step of preparing the mint-extract stock solution containing the extracted mint further comprises:

after the quenching process, filtering out crystal substances from the mint-extract crude solution, followed by a defoaming process.

6. The method according to claim 1, wherein the mint-extract residue is mixed with the one or more pulps at a ratio of about 1:3 to about 1:6 by weight.

7. The method according to claim 1, wherein, after mixing the mint-extract residue with the one or more pulps, the step of preparing the viscose spinning solution further comprises:

one or more processes selected from an impregnation process, a squeezing process, a crushing process, an aging process, a xanthation process, and a dissolving process, to obtain the viscose spinning solution.

8. The method according to claim 7, wherein:

an impregnation surfactant of about 0.01% to about 0.02% by weight of the cellulose in the viscose spinning solution is used in the impregnation process, a crush denaturing agent of about 0.02% to about 0.03% by weight of the cellulose in the viscose spinning solution is used in the crushing process, and a dissolution denaturing agent of about 1.0% to about 2.0% by weight of the cellulose in the viscose spinning solution is used in the dissolving process.

9. The method according to claim 7, wherein:

an impregnation surfactant in the impregnation process comprises a hydrophilic anionic surfactant comprising sulfonated castor oil, alkyl ammonium polyoxyethylene glycol, or a combination thereof, a crush denaturing agent in the crushing process comprises polyoxyethylene glycol ether, hydroxyethyl aliphatic amine, or a combination thereof, and a dissolution denaturing agent in the dissolving process comprises polyethylene glycol, urea, or a combination thereof.

10. The method according to claim 7, wherein the whole mint plant further includes raw materials of chloranthus, glaber, apocynum, tuckahoe, isatin root, wormwood, or a combination thereof.

11. The method according to claim 1, wherein the viscose spinning solution has:

a fiber concentration of about 9.0% by weight of total amount of the viscose spinning solution, an alkali concentration of about 4.80% by weight of total amount of the viscose spinning solution, a viscosity of about 50.0 s/cm$^2$, a degree of maturation with 10% ammonium chloride value of about 14.0 mL, and a filtration resistance constant Kw of about 100 or less.

12. The method according to claim 1, wherein the step of preparing the mint-viscose blend comprises:

prior to spinning, adding the mint-extract stock solution into a dynamic mixer through a metering pump, wherein the mint-extract stock solution is in an amount such that extracted mint in the mint-extract stock solution has a ratio with the mint-containing composite cellulose fiber for about 10% to about 20% by weight, and simultaneously adding the viscose spinning solution into the dynamic mixer through a viscose flowmeter.

13. The method according to claim 1, wherein the step of spinning the mint-viscose blend comprises:

introducing the mint-viscose blend in a coagulation bath, wherein the coagulation bath includes about 70 g/L to about 120 g/L of sulfuric acid, about 4 g/L to about 8 g/L of aluminum sulfate, and about 320 g/L to about 350 g/L of sodium sulfate, at a temperature of about 40 to about 60° C.

14. The method according to claim 1, wherein the step of spinning the mint-viscose blend further comprises:

conducting a fiber drawing process having about 20% to about 15% nozzle draw, about 20% to about 45% disc draw, and about 5% to about 20% plasticizing bath draw.

15. The method according to claim 1, wherein the step of spinning the mint-viscose blend further comprises:

one or more processes selected from a cutting process, a water washing process, a desulfurizing process, and an oil treating process of the mint-containing composite cellulose fiber, wherein the desulfurizing process uses a desulfurizing bath comprising about 2 g/L to about 6 g/L of sodium sulfite at about 30° C. to about 60° C.

16. The method according to claim 1, wherein the mint-containing composite cellulose fiber includes:

the cellulose of about 85% to about 95% by weight of the total mint-containing composite cellulose fiber, and the mint-extract of about 5% to about 15% by weight of the total mint-containing composite cellulose fiber, wherein the mint-containing composite cellulose fiber further includes one or more pulps selected from a cotton pulp, a wood pulp, a bamboo pulp, a wool pulp, a linen pulp, a silk pulp, a Tencel pulp, and a Modal pulp.

17. The method according to claim 1, wherein the mint-containing composite cellulose fiber has a dry breaking strength greater than about 2.0 cN/dtex, a wet breaking strength greater than about 1.1 cN/dtex, a dry breaking elongation greater than about 16%, and a line density deviation of about 7%.

18. The method according to claim 1, wherein the mint-containing composite cellulose fiber has a whiteness of about 38% to about 48%, a bacteriostatic logarithm value greater than about 2.0, a bactericidal logarithm value greater than 0, and a coolness coefficient greater than about 0.20 $W/cm^2$.

* * * * *